United States Patent [19]

Rozmus

[11] 4,229,872

[45] Oct. 28, 1980

[54] METHOD FOR FILLING AND SEALING A CONTAINER

[75] Inventor: Walter J. Rozmus, Birmingham, Mich.

[73] Assignee: Kelsey-Hayes Company, Romulus, Mich.

[21] Appl. No.: 934,986

[22] Filed: Aug. 18, 1978

[51] Int. Cl.[3] ..... B22F 3/24; B65D 81/00; B65B 31/02

[52] U.S. Cl. ..... 29/420; 53/477; 53/440

[58] Field of Search ..... 29/422, 401 C, 400 C; 53/489, 440, 477, 478, 474, 488

[56] References Cited

U.S. PATENT DOCUMENTS 3,926,306 12/1975 Van Nederveen ..... 206/84

FOREIGN PATENT DOCUMENTS 196027 2/1958 Austria ..... 29/422

*Primary Examiner*—Francis S. Husar
*Assistant Examiner*—V. K. Rising
*Attorney, Agent, or Firm*—McGlynn and Milton

[57] ABSTRACT

A method for filling and sealing a container which includes a fill tube for filling the container with particulate material, e.g., powder metal, wherein at least a portion of the fill tube is filled with powder metal and a section of the filled portion is heated to melt the powder metal. The molten metal is then permitted to solidify thereby forming a fused mass of material in the fill tube which hermetically seals the container.

3 Claims, 2 Drawing Figures

METHOD FOR FILLING AND SEALING A CONTAINER

FIELD OF THE INVENTION

This invention relates to a method for filling and sealing a container which is adapted to contain a quantity of particulate material under a pressure which is below ambient pressure. The invention is particularly suited for use in hot consolidating powder metal by means of hot isostatic compaction, press consolidation, and other processes in which the powder metal is contained in an evacuated container during hot consolidation.

BACKGROUND OF THE INVENTION

In certain processes for hot consolidating powder metal, the powder metal is sealed in an evacuated metal container under a vacuum (typically about 10 microns). Thereafter, the filled and sealed container is subjected to heat and pressure, as for example, in an autoclave, to hot consolidate the powder metal. Since the container is maintained under a vacuum it is necessary to perfect a reliable seal subsequent to filling to prevent leakage of gas into the container. Should a leak develop in the container prior to, or during, hot consolidation an unacceptable part will be produced due to the porosity which is caused by the gas entering the container. Containers for hot consolidating powder metal are particularly susceptible to leaks when hot consolidation is carried out in an autoclave due to the fact that the container is subjected to gas pressure between 10,000 and 30,000 psi thereby greatly increasing the difference in pressure between the interior and exterior of the container. Consequently, containers for hot consolidation are carefully tested prior to use to insure their integrity.

In order to fill the containers with powder metal, the containers are provided with a metal fill tube, or tubulation, which communicates with the interior of the container. The fill tube is carefully joined and sealed to the container to prevent leaks between the tube and the container. The fill tube is connected to a source of powder metal and also to means for evacuating the container, such as a vacuum pump. After the container has been evacuated, the container is filled with powder metal. A critical stage of this operation is sealing the fill tube subsequent to the evacuation and filling of the container. One method for sealing the fill tube includes a combination of crimping and welding. More specifically, the end of the fill tube is crimped and folded over one or more times and then welded. This procedure is not only difficult and time consuming, but often results in a leaking container due to cracks formed in the fill tube during crimping or holes formed in the fill tube during welding. The instant invention provides a relatively simple and reliable method for sealing the fill tube which is not subject to the drawbacks encountered in the previously described method.

SUMMARY OF THE INVENTION

The instant invention comprises a method for filling and sealing a container, and the filled and sealed container resulting therefrom, in which, subsequent to evacuation, the container and at least a portion of the fill tube are filled with particulate material, such as powder metal. A relatively small section of the filled portion of the tube is then heated to melt the particulate material located in that region of the fill tube. The fill tube is then cooled to solidify the molten particulate material thus forming a plug of material which hermetically seals the fill tube and container.

STATEMENT OF PRIOR ART

The Examples of apparatuses and methods for sealing a container which includes crimping the fill tube or a combination of crimping and welding the fill tube are disclosed in the U.S. Pat. Nos. 3,145,456; 3,799,651; and 3,986,630.

An alternate method for sealing a container filled with particulate material which includes melting a portion of the particulate material is described in the U.S. Pat. No. 3,926,306. In the method disclosed in this patent an open ended container is filled inside an evacuated chamber. After filling the container is sealed by exposing its open end to a weld beam, such as an elctron beam, which melts an upper layer of the material. Upon solidifying the material forms a portion of the container walls.

DETAILED DESCRIPTION OF THE INVENTION

Figure 1:
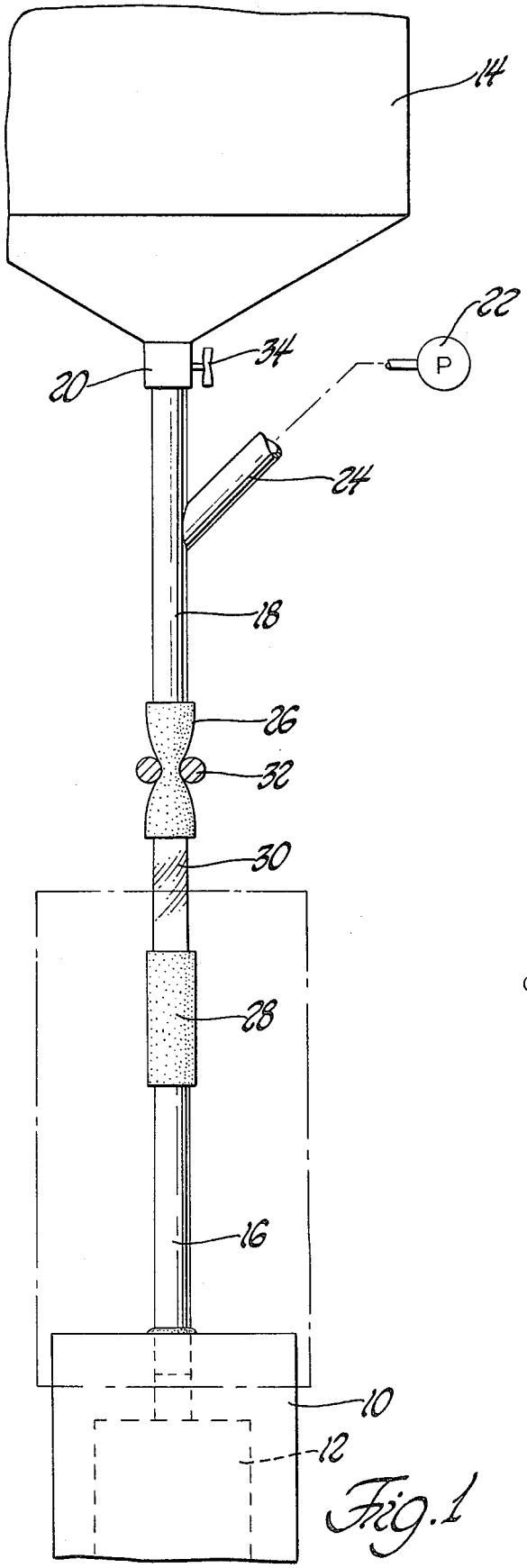
FIG. 1 is a partially schematic, elevational view of an apparatus typically employed for evacuating and filling a container with particulate material

With reference to FIG. 1, a container 10 is shown which includes an internal cavity 12 which is to be filled with powder metal. As is standard practice in the powder metallurgy art, the cavity 12 has a shape which corresponds to the shape of the article to be produced. While a simple shape is shown for purposes of illustration, it is noted that relatively complex articles can be produced using these techniques. In other words, the container 10 is representative of a metal container used for hot consolidating powder metal. The container may include thin walls (on the order of $\frac{1}{8}$ inch) or thick walls (on the order of 1 inch and greater) and can be made of any metallic material which has been found suitable for hot consolidating powder metal. Generally, thin-walled metal containers have been made from stainless steel while thick-walled containers have been conveniently made from a low alloy, low carbon steel (e.g. SAE 1010).

Figure 2:
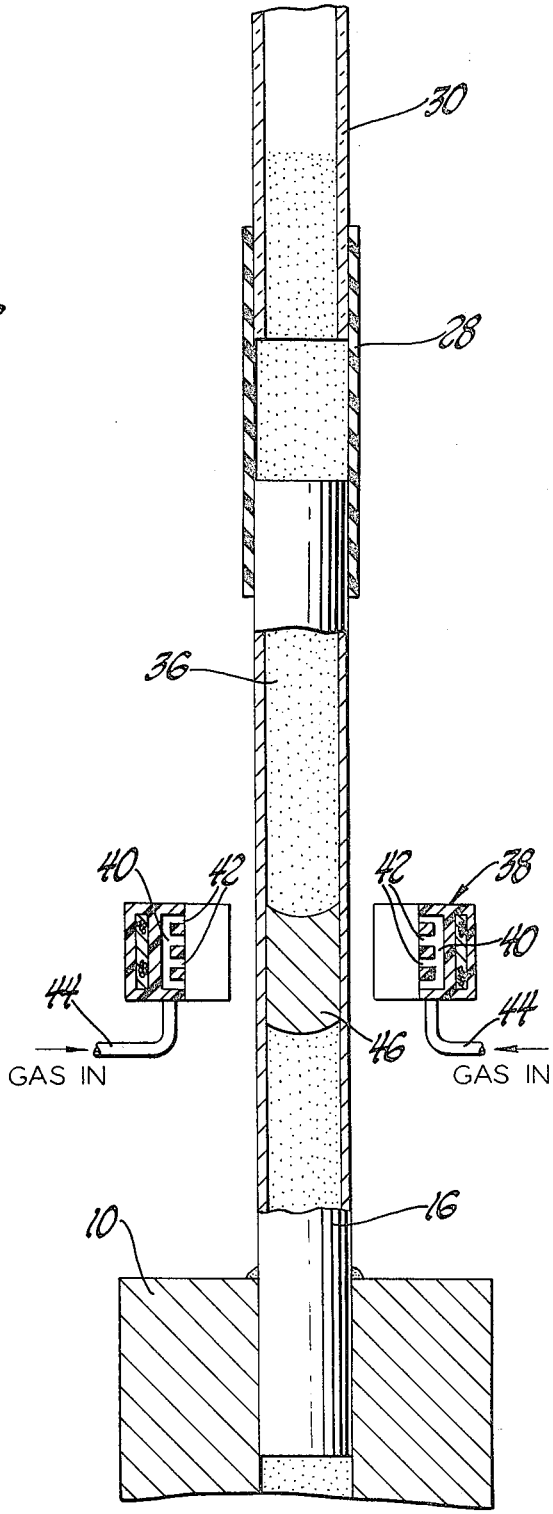
FIG. 2 is an enlarged, partially schematic elevational view of the indicated portion of FIG. 1 including means for sealing the fill tube of the filled container.

In order to fill the cavity 12 within the container 10 a fill tube, or tubulation, 16 is joined and sealed to the container 10. As shown in FIG. 2, the fill tube 16 extends into an opening in the container 10. The fill tube 16 is joined to the container 10 by welding to hermetically seal the fill tube to the container 10. The fill tube 16 is connected to a storage container 14 which contains a quantity of powder metal maintained under a vacuum to prevent contamination. More specifically, a glass or metal tube 18 is connected to the outlet 20 of the storage container 14. This tube 18 is connected to a vacuum pump 22 through a branch line 24. The vacuum pump 22 is employed to evacuate the system and the container 10 prior to filling the cavity 12 within the container 10.

A flexible connecting tube 26 made of rubber or like material is connected to the end of the tube 18 and a similar flexible connecting tube 28 is connected to the end of the fill tube 16. Interposed between the two flexible tubes 26 and 28 is a sight tube 30 made of glass or some other transparent material.

Before the storage container 14 is connected to the fill tube 16 of the container 10 by means of the associated conducting tubing the system is closed off by means of a clamp, which is illustrated schematically at 32, for closing the flexible connecting tube 26. Additionally, the storage container 14 is closed by means of a control valve 34. After the conducting tubing is connected to the fill tube 16, the clamp 32 is released and the pump 22 is activated to evacuate the cavity 12 within the container 10 and the associated tubing. When the desired vacuum is obtained, e.g., 10 microns for nickel-base superalloys, the control valve 34 is opened so that particulate material flows by gravity into the container 10 through the fill tube 16.

The container is filled with particulate material 36 until the particulate material can be observed through the sight tube 30. This insures that not only the container cavity, but at least a portion of the fill tube 16 will be filled with particulate material. In order to facilitate filling the container 10 may be vibrated so that the particulate material achieves its maximum tap density.

After the container is filled in the manner described, a section of the filled portion of the fill tube 16 is heated to melt the particulate material in that region of the fill tube. A preferred device for heating a section of the fill tube 16 comprises an induction coil generally indicated at 38. Since the metal fill tube 16 is an electrical conductor it can be heated by electromagnetic conduction. More specifically, as alternating current is caused to flow through the inductor 38 a highly concentrated, rapidly alternating magnetic field is established. The alternating magnetic field induces the flow of current in the fill tube and possibly to some extent in the particulate material in the event that it is a conductor, such as powder metal. The resistance of the fill tube and the particulate material to the flow of the induced current causes heating by $I^2R$ losses.

Since the distribution of induced current is a maximum on the surface of the fill tube and decreases rapidly within the fill tube it is suspected that the current penetrates only the fill tube and possibly a small layer of adjacent particulate material. In any event heat produced by the current rapidly progresses to the interior by conduction so that the particulate material can be entirely melted to the center of the fill tube.

An induction coil found practical for use is of the type which is commonly employed for induction hardening and tempering of metals. A split-ring coil design is used so that the coil can be opened and closed around the fill tube 16. An induction coil capable of operating at a frequency of 3,000 cycles per second and a generator rating of 15 kilowatts has been found satisfactory. This type of induction coil is generally air or water cooled.

Since relatively thin-walled fill tubes are employed, ($\frac{1}{8}$ inch wall thickness) oxidation of the fill tube 16 can cause leaks. Therefore, heating of the fill tube 16 is carried out under a non-oxidizing condition. Induction coils of the type referred to include an internal manifold 40 having outlet ports 42 which are directed toward the surface of the fill tube 16. While this feature is normally employed for quenching the surface of the port, this feature is employed in the instant invention to prevent oxidation of the fill tube's surface. An inert gas, such as nitrogen or argon, is conducted into the manifold 40 through the gas inlets 44 and exits through the outlet ports 42 to flush the heated section of the fill tube 16. The inert gas prevents oxidation of the heated portion of the fill tube. It is noted, however, that this procedure is only followed when oxidation is a problem. For example, special precautions to prevent oxidation are not necessary if the fill tube is made of stainless steel. Such precautions are necessary, however, when the fill tube is made of a low alloy, low carbon steel, such as SAE 1010.

After heating and melting the powder metal, the fill tube 16 is cooled to solidify the molten particulate material to form a fused mass or slug 46 in the fill tube. Since the fused mass or slug 46 is gas impervious and tightly adheres to the entire surface of the fill tube 16, the fill tube 16 and container 10 are hermetically sealed. At this point, the fill tube 16 is disconnected from the flexible connecting tube 28 and is removed for subsequent processing.

A number of tests were conducted using various nickel-base and cobalt-base alloys. The tests were conducted on low carbon steel tubes (SAE 1010–1020) since such tubes are generally employed as fill tubes. Moreover, as should be apparent, it is essential that the tube material have a higher melting point than the particulate material contained therein. Tests indicated that tubes having a $\frac{3}{4}$ inch outer diameter and a $\frac{5}{8}$ inch inner diameter could be sealed by energizing the induction coil for 2 to 3 minutes at a frequency of 3,000 cycles per second and a power output from 12–18 kilowatts. It should be recognized that these test values are merely experimental and will vary depending upon the size of the tube, the materials employed, the type and size of inductor, and other variables.

While it is not proven to be absolutely essential, it is felt that an important consideration for insuring a hermetic seal between the fused mass of particulate material and the inside of the tube is the cleanliness of the tube. Therefore, before being used the insides of the tubes are thoroughly cleaned to insure that the fused mass of particulate material will bond tightly to the inside of the tube. By way of example, the tubes in the tests were washed with a degreaser, such as acetone, and then scratch brushed to remove any surface oxidation. The tubes were then rewashed to remove dust and other loose foreign material. This procedure insured a clean surface which promotes bonding. It is also noted that the conditions for bonding are further enhanced due to the fact that the interior of the tube is under a vacuum thus preventing oxidation which would inhibit bonding.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that the invention may be practiced otherwise than as specifically described herein and yet remain within the scope of the appended claims.

I claim:

1. A method for filling and sealing a container which is adapted to contain a particulate material under a pressure which is below ambient pressure, the container including a fill tube which is joined and sealed thereto comprising the steps of providing a source of particulate material and means for evacuating the container, connecting the fill tube of the container to the source of particulate material and to the means for evacuating the container, evacuating the container to a desired pressure below ambient pressure, filling the container and at least a portion of said fill tube with particulate material, heating a section of the filled portion of the fill tube to melt some of the particulate material in the fill tube, and cooling the fill tube to solidify the molten particulate material to thereby hermetically seal the fill tube container.

2. The method set forth in claim 1 wherein the step of heating is further defined as heating the section of the fill tube by an induction coil disposed around the fill tube.

3. The method set forth in claim 1 wherein the step of heating a section of the filled portion of the fill tube is conducted under a non-oxidizing condition.

* * * * *